US006846107B2

(12) United States Patent
Sweeney et al.

(10) Patent No.: US 6,846,107 B2
(45) Date of Patent: Jan. 25, 2005

(54) GLUE DROP END STOPS FOR ZIPPERED BAG

(75) Inventors: Gerald Sweeney, LaJolla, CA (US); Howard Schwan, Crystal Lake, IL (US); Brent Anderson, Barrington, IL (US)

(73) Assignee: CTI Industries Corporation, Barrington, IL (US)

( * ) Notice: Subject to any disclaimer, the term of this patent is extended or adjusted under 35 U.S.C. 154(b) by 0 days.

(21) Appl. No.: 10/198,799

(22) Filed: Jul. 19, 2002

(65) Prior Publication Data

US 2004/0014579 A1 Jan. 22, 2004

(51) Int. Cl.[7] ..... B65D 33/16
(52) U.S. Cl. ..... 383/64; 24/399; 24/585.12
(58) Field of Search ..... 383/63, 64; 24/399, 24/400, 585.12

(56) References Cited

U.S. PATENT DOCUMENTS 3,790,992 A 2/1974 Hertz
3,986,914 A 10/1976 Howard
4,523,918 A 6/1985 Ausnit
4,534,752 A 8/1985 Ferrell et al.
4,620,320 A 10/1986 Sullivan
5,020,194 A 6/1991 Herrington et al.
5,067,208 A 11/1991 Herrington et al.
5,088,971 A 2/1992 Herrington et al.
5,131,121 A 7/1992 Herrington et al.
5,161,286 A 11/1992 Herrington et al.
5,189,764 A * 3/1993 Herrington et al. ..... 24/384
5,301,395 A 4/1994 Richardson
5,405,478 A 4/1995 Richardson et al.
5,426,830 A 6/1995 Richardson et al.
5,442,837 A 8/1995 Morgan
5,448,807 A 9/1995 Herrington, Jr.
5,482,375 A 1/1996 Richardson et al.
5,664,299 A * 9/1997 Porchia et al. ..... 24/400
5,669,715 A 9/1997 Dobreski et al.
5,722,128 A 3/1998 Toney et al.
5,769,772 A 6/1998 Wiley
5,809,621 A 9/1998 McCree et al.
5,833,791 A 11/1998 Bryniarski et al.
5,836,056 A 11/1998 Porchia et al.
5,896,627 A 4/1999 Cappel et al.
5,924,173 A 7/1999 Dobreski et al.
5,947,603 A 9/1999 Tilman
5,950,285 A 9/1999 Porchia et al.
5,956,815 A 9/1999 O'Connor et al.
5,991,980 A 11/1999 Meager
6,178,602 B1 1/2001 Burke et al.
6,286,189 B1 9/2001 Provan et al.
6,286,191 B2 9/2001 Van Erden
6,286,999 B1 9/2001 Cappel et al.
6,287,001 B1 9/2001 Buchman
6,293,701 B1 9/2001 Tomic
6,327,754 B1 12/2001 Belmont et al.
6,347,437 B2 2/2002 Provan et al.
6,347,914 B1 2/2002 Boyle
6,364,530 B1 4/2002 Buchman
6,378,177 B1 4/2002 Athans et al.
6,442,804 B2 * 9/2002 Turvey et al. ..... 24/399
6,508,969 B1 * 1/2003 Kolovich et al. ..... 264/252
6,569,368 B2 * 5/2003 Machacek ..... 264/155
6,662,410 B2 * 12/2003 Kolovich et al. ..... 24/399

* cited by examiner

*Primary Examiner*—Jes F. Pascua
(74) *Attorney, Agent, or Firm*—Joseph A. Fuchs; Everest Intellectual Property Law Group

(57) ABSTRACT

The present invention provides a provides an airtight bag that includes a bag having a mouth and an outer surface. The bag further includes a zippered closure at the mouth, the zippered closure having a first end and a second end, and a first drop on the outer surface of the bag at one of the first end or the second end of the zippered closure.

32 Claims, 6 Drawing Sheets

GLUE DROP END STOPS FOR ZIPPERED BAG

BACKGROUND OF THE INVENTION

The present invention relates to airtight zippered bags, and more particularly, to end stops for sliders used in connection with such bags. It is known to use airtight plastic bags and containers to conveniently store bulky materials such as clothing and bedding. Airtight plastic bags are also known to store food and other materials. Examples of such airtight bags are disclosed in U.S. Pat. Nos. 6,357,915; 6,116,781; and 5,480,030, each of which is incorporated herein by reference. Airtight bags allow air to be removed from bulky items such as comforters and sweaters, and the bag sealed to essentially "shrink" the items stored inside the bag. Air can be compressed from the contents, for example, by rolling the contents,prior to closing the bag. The bags may also have a one-way valve through which a vacuum attachment can be affixed to evacuate the air from inside the bag using a conventional household vacuum cleaner. Removal of air reduces the amount of space necessary to store the items. The bags are typically made of materials such as bi-axial layers of nylon and polyethylene to make the bags air and moisture impermeable, and hold the airtight vacuum seal.

The bags have an airtight zippered closure at the mouth of the bag. An example of an airtight zippered closure is disclosed in U.S. Pat. No. 6,033,113, incorporated herein by reference. Often associated with the zippered closure is a slider that facilitates sealing the airtight zippered closure. The slider must be secured to the bag so that it will not come off the ends of the zippered closure.

Prior art attempts to prevent the slider from coming off the ends of the bag have included deforming the ends of the zippered closure, clamps, end stops fused onto the zipper or created from the zipper material, and posts placed in the ends of the bag. Examples of prior art end stops include those disclosed in U.S. Pat. Nos. 6,287,001; 5,950,285; 5,924,173; 5,836,056; 5,833,791; 5,448,807; 5,442,837; 5,405,478; 5,161,286; 5,131,121; 5,088,971; and 5,067,208.

Many of these prior art end stops for zippered closures deform or penetrate the ends of the bag or the zippered closure causing the bag or zippered closure to leak. Thus, the prior art end stops do not ensure the bag will be airtight.

SUMMARY OF THE INVENTION

The present invention provides an airtight bag that includes a bag having a mouth and an outer surface. The bag further includes a zippered closure at the mouth, the zippered closure having a first end and a second end, and a first drop on the outer surface of the bag at one of the first end or the second end of the zippered closure.

The present invention also provides a method of making an airtight bag that includes the steps of providing a bag having a mouth and an outer surface. The bag also has a zippered closure at the mouth. The zippered closure has a first end and a second end. The method further includes placing a first drop on the outer surface of the bag at one of the first end or the second end of the zippered closure.

In a further embodiment, the present invention provides a method of sealing a bag, the bag having a mouth and an outer surface, and a zippered closure at the mouth. The zippered closure has a first end and a second end defining a length. The zippered closure also has an interlockable front profile and back profile. The method includes providing a slider having a first edge and a second edge adapted to interlock the front profile and back profile. It also includes sliding the slider along the length of the zippered closure to interlock the front profile and back profile, and terminating sliding upon the first edge or the second edge of the slider contacting a drop placed at either one of the first end or the second end of the zippered closure.

The end stops of the present invention do not deform or penetrate the zipper closure, thus ensuring the airtightness of the bag. Additional features and advantages of the present invention are described in, and will be apparent from, the following Detailed Description of the Invention and the figures.

DETAILED DESCRIPTION OF THE INVENTION

Figure 1:
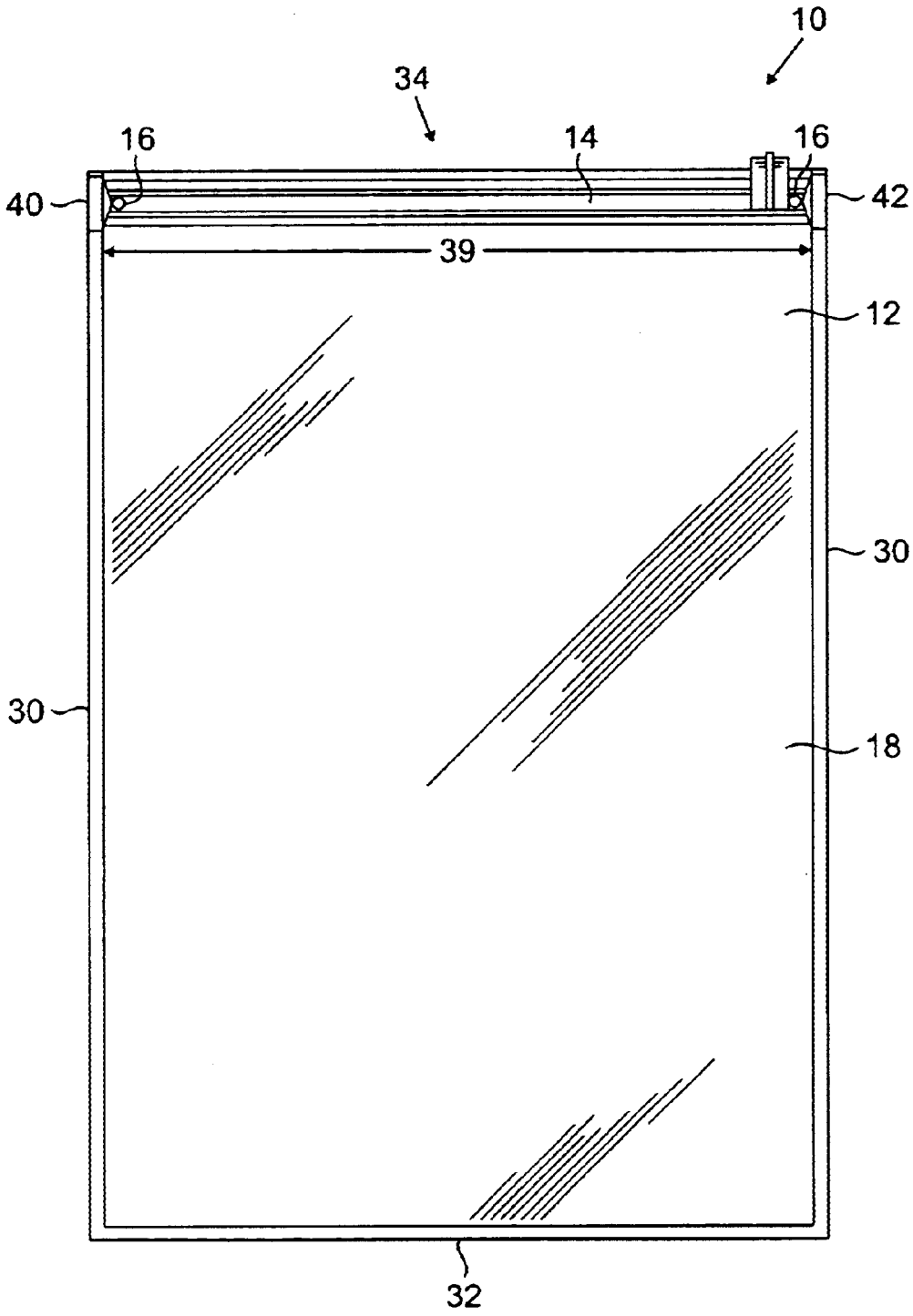
FIG. 1 is a plan view of a bag in accord with an embodiment of the present invention.

FIG. 1 shows a bag assembly 10 made in accord with an embodiment of the present invention. The bag assembly 10 includes a bag 12, a zippered closure 14, and a pair of drops 16 that act as end stops. The bag 12 is formed from a front layer 18 and a back layer 20. The front layer 18 has an inner surface 22 and an outer surface 24. The back layer 20 has an inner surface 26 and an outer surface 28 (FIG. 4).

The front layer 18 and back layer 20 are preferably placed in registration and sealed along their side edges 30 and bottom 32 to form the bag 12. Any suitable means to seal the front layer 18 and back layer 20 may be used, but they are preferably heat sealed. The bag 12 has a mouth 34 which is not heat sealed.

The front layer 18 and back layer 20 may be a monolayer structure or a multiple layer structure. The multiple layer structures can be formed by coextrusion, extrusion, lamination, extrusion lamination, or other processes well known in the art. The front layer 18 and back layer 20 are preferably each made from bi-axial layers of polyethylene and nylon, but may be any suitable material or combination of materials, and may, in one embodiment, be airtight.

Figure 2:
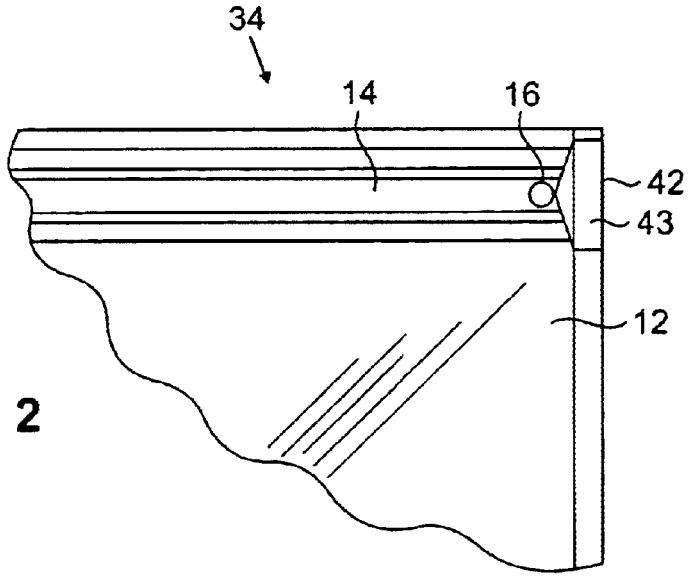
FIG. 2 is an enlarged plan view of one end of the bag of FIG. 1.
Figure 3:
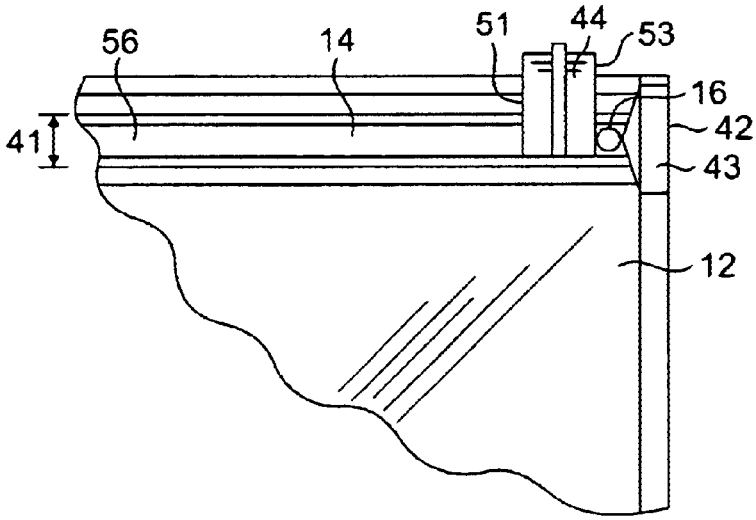
FIG. 3 is a further enlarged plan view of one end of the bag of FIG. 1.
Figure 4:
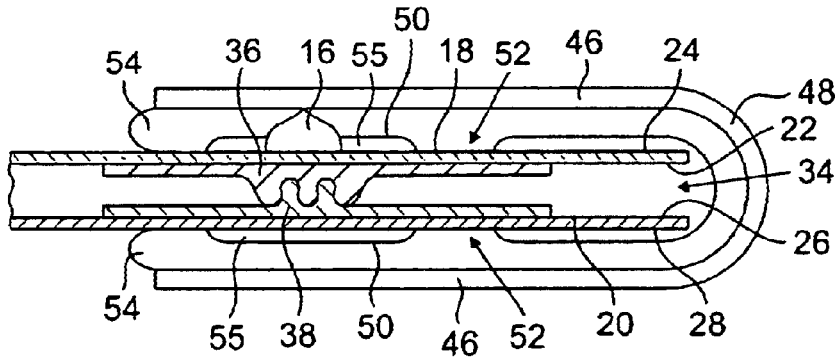
FIG. 4 is an end view of the bag, zippered closure, and drops of an embodiment of the present invention.

FIGS. 2–4 show enlarged views of the bag 12, zippered closure 14, and drops 16. The zippered closure 14 is located at the mouth 34 and seals the mouth 34 of the bag 12. The zippered closure 14 includes a front zipper profile 36 attached to the inner surface 22 of the front layer 18, and a back zipper profile 38 attached to the inner surface 26 of the back layer 20. The front zipper profile 36 and back zipper profile 38 are preferably heat sealed to the inner surfaces 22 and 26 of the front layer 18 and back layer 20, but may be attached using any suitable means, including adhesives. The front zipper profile 36 and back zipper profile 38 interlock to provide an airtight seal at the mouth 34 of the bag 12. The front zipper profile 36 and back zipper profile 38 are preferably configured and interlock as disclosed in U.S. Pat. No. 6,033,113.

The zippered closure 14 has a first end 40 and a second end 42 defining a length 39. The zippered closure 14 also has a width 41. The first end 40 and second end 42 of the zippered closure 14 are each melted, or "crushed," using heat sealing and pressure (FIGS. 5 and 6) to define crushed sections 43. "Crushing" is conventional in the art.

The zippered closure 14 preferably includes a slider 44. The slider 44 has a pair of legs 46 extending from opposite sides of a rounded portion 48. The legs 46 each have an inner profile 50 that permits them to seat on the zippered closure 14. The inner profile 50 has opposing top protrusions 52 and a bottom opposing protrusions 54. The top protrusions 52 are above the zippered closure 14 and the bottom protrusions 54 are below the zippered closure 14. When sealing the zippered closure 14, the top and bottom protrusions 52 and 54 contact the outer surfaces 24 and 28 of the front layer 18 and back layer 20. The legs 46 each have a first edge 51 and a second edge 53. The slider 44 is preferably made of a plastic material, and in a preferred embodiment is made of polyethylene, but may be made of any suitable material. A recessed portion 55 of each leg 46 accommodates the first and second zipper profiles 36 and 38. The legs 46 are squeezed together by the user to force the front zipper profile 36 and back zipper profile 38 to interlock.

The pair of drops 16 are preferably placed on the outer surface 24 of the front layer 18 of the bag 12, one each at the first end 40 and second end 42 of the zippered closure 14. The drops 16, may, however, be placed on the outer surface 28 of the back layer 20, one each at the first end 40 and second end 42 of the zippered closure 14. Alternatively, one of the pair of drops 16 may be placed on the outer surface 24 of the front layer 18, and the other may be placed on the outer surface 28 of the back layer 20, one drop 16 at each of the first and second ends 40 and 42 of the zippered closure 14. Further, a total of four drops may be used, two each at the first and second ends 40 and 42 on each of the front layer 18 and back layer 20 of the bag 12. A single drop 16 at either the first end 40 or second end 42 may also be used.

Figure 11:
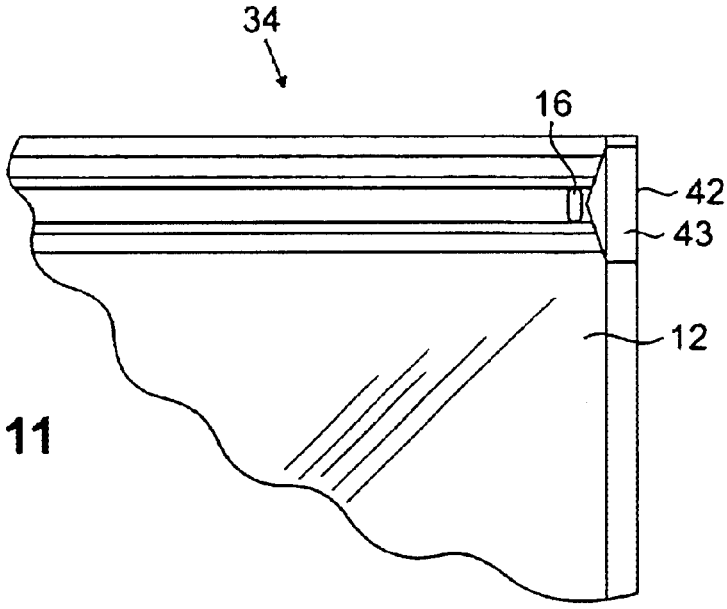
FIG. 11 is a plan view of one end of the bag in accord with an embodiment of the present invention.

The drops 16 are preferably circular in shape, but may be any suitable shape, such as linear as shown in FIG. 11. The drops 16 can be comprised of any suitable substance, but are preferably of a glue curable with ultraviolet light. Alternatively, the drops 16 can have an adhesive backing so they may be selectively placed on the bag 12. The adhesive-backed drops 16 may be applied mechanically or manually. The adhesive may, for example, be glue or double sided tape suitable for applying the dots to the bag 12.

When sealing the bag 12, the first edge 51 of the slider 44 is moved along the zippered closure until contacts the first drop 16 at the first end 40 of the zippered closure 14. If a second drop 16 is used, the second edge 53 of the slider 44 would contact the drop 16 at the second end 42 of the zippered closure 14. In a preferred embodiment, the drops 16 are placed approximately 0.50 inches from each of the side edges 32 of the bag 12. The drops 16 are preferably generally centered on the width 41 of the zippered closure 14. The drops 16 must be placed such that the zippered closure 14 completely interlocks the front and back zipper profiles 36 and 38 of the zippered closure 14 to ensure the bag 12 is airtight. The drop 16, therefore, must allow the first edge 51 and second edge 53 of slider 44 to substantially reach the first and second ends 40 and 42 of the zippered closure 14 before the crushed sections 43.

Figure 5:
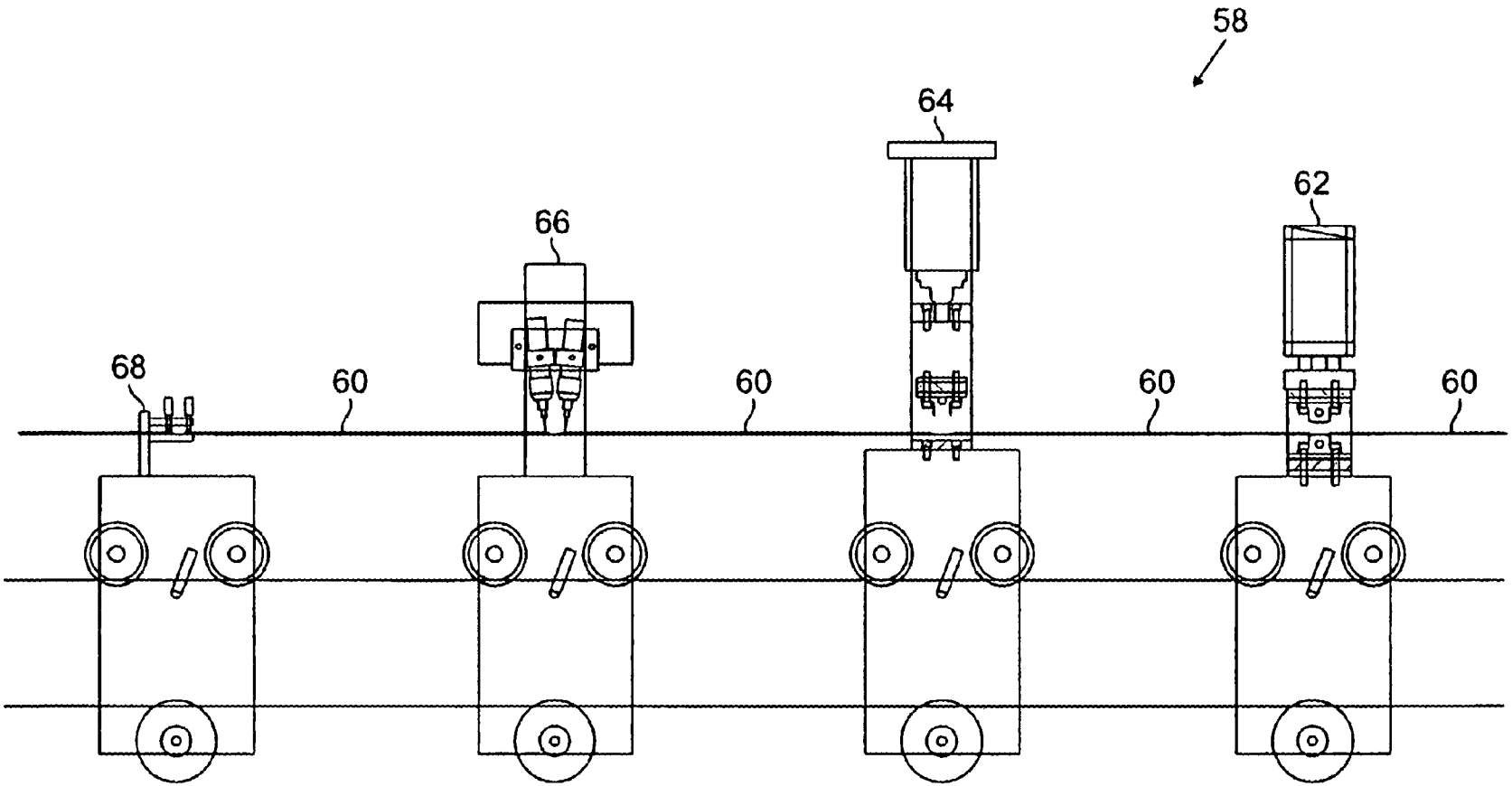
FIG. 5 is a schematic plan view of the method of an embodiment of the present invention.

FIG. 5 shows a schematic diagram of a preferred method 58 by which the pair of dots 16 are applied to the bag 12. A film 60 with the zippered closure 14 attached passes through a zipper crusher 62. In FIG. 5, the mouth 34 and zippered closure 14 are nearest the viewer. The film 60 is continuous. The zipper crusher 62 applies heat and pressure at selected intervals to the zippered closure 14 depending on bag size. The zipper crusher 62 creates the first end 40 of one bag 12 and the second end 42 of the succeeding bag 12 along the continuous film 60. The zipper crusher 62 essentially melts the front zipper profile 36 and back zipper profile 38 together at the point where the zipper crusher 62 contacts the film 60.

After crushing, the film 60 is cross-sealed at cross-sealer 64. The cross-sealer 64 is preferably a heat sealer, but may be any suitable sealer. The cross-sealer 64 creates seals for the side edges 30 along the length of the bag 12. In FIG. 5, the length of the bag extends perpendicular and into the plane of the page. One cycle of the heat sealer creates the left side edge of one bag 12, and the right side edge of the succeeding bag 12 in the continuous film 60. A cut is made between the cross seals to make separate bags 12 from the continuous film 60.

After cross-sealing, the film 60 continues to a glue applicator 66. The glue applicator 66 applies the glue drops 16 to either side of the crushed section 43. The preferred glue is a ultraviolet (UV) light curable glue. One example of such glue that may be used with the present invention includes Dymax 3069 UV curable glue, manufactured by Dymax Corporation of Torrington, Conn.

After the glue is applied by glue applicator 66, the drops 16 are cured at the glue curing station 68. At the glue curing station 68, ultraviolet light is directed to the drops 16, thereby curing the drops 16. Curing light is supplied by a conventional light box (not shown).

Figure 6:
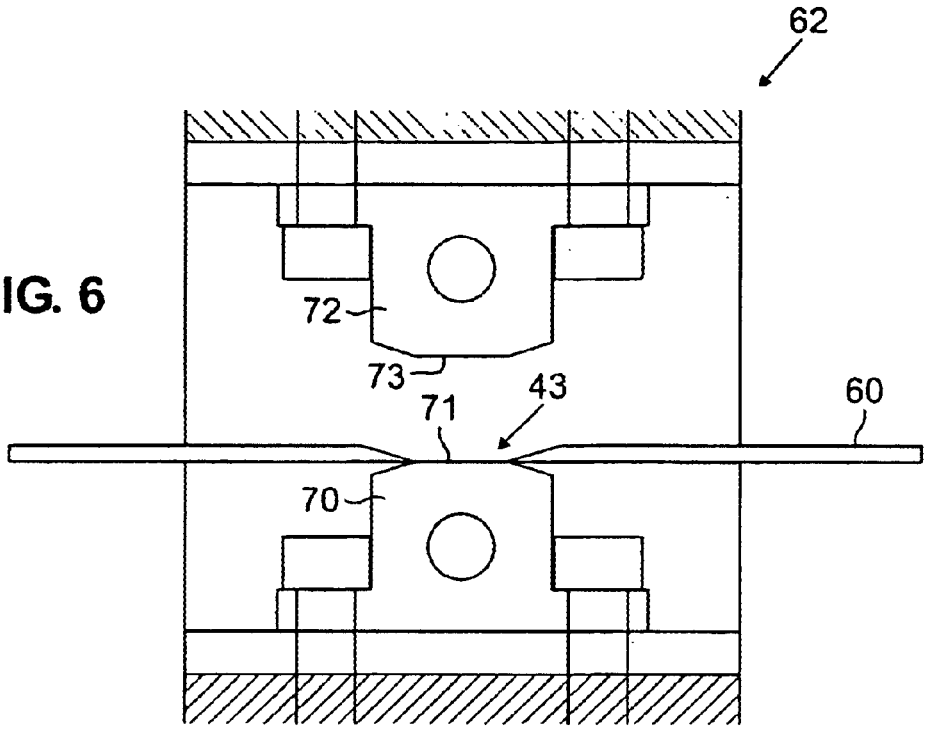
FIG. 6 is a schematic plan view of the zipper crusher of an embodiment of the present invention.

FIG. 6 shows a schematic of the zipper crusher 62. The film 60 with the zippered closure 14 attached enters one side of the zipper crusher 62. The zipper crusher 62 includes a lower die 70 and upper die 72. The lower die 70 and upper die 72 have substantially flat sections 71 and 73. The lower die 70 and upper die 72 are heated and pressed together at the substantially flat sections 71 and 73 to create the crushed section 43 of the zippered closure 14. Preferably, the upper and lower dies 70 and 72 are heated to approximately 350° F. Only of upper or lower dies 70 or 72 need be heated, but both are preferably heated. The crushed section 43 is created by melting together the front zipper profile 36 and rear zipper profile 38.

Figure 7:
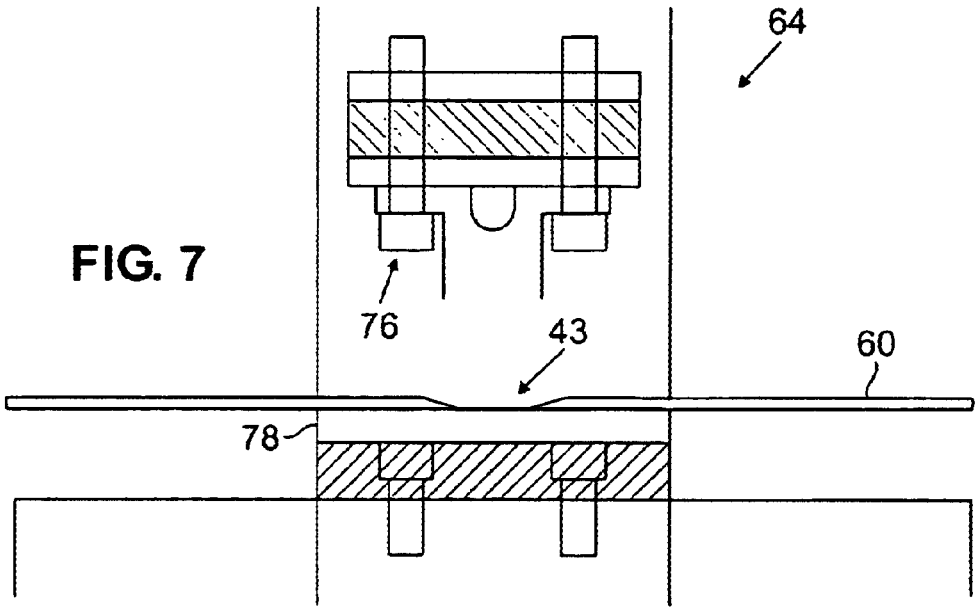
FIG. 7 is a schematic plan view of the cross-sealer of an embodiment of the present invention.

FIG. 7 shows a schematic of the cross-sealer 64. The cross-sealer 64 has a sealing head 76 and a platform 78 that extends the length of the film 60. The sealing head 76 is heated and meets the platform 78 for a predetermined amount of time to heat seal the front layer 18 and back layer 20 together at their inner surfaces 22 and 26. In a preferred embodiment, only the sealing head 76 is heated, but the platform 78 may also be heated. The sealing head 76 is heated to approximately 300° F. To create separate bags 12, the film 60 is cut along the center of the length of the heat seal created by the sealing head 76. The cutting operation (not shown) may occur at any suitable place in the process.

Figure 8:
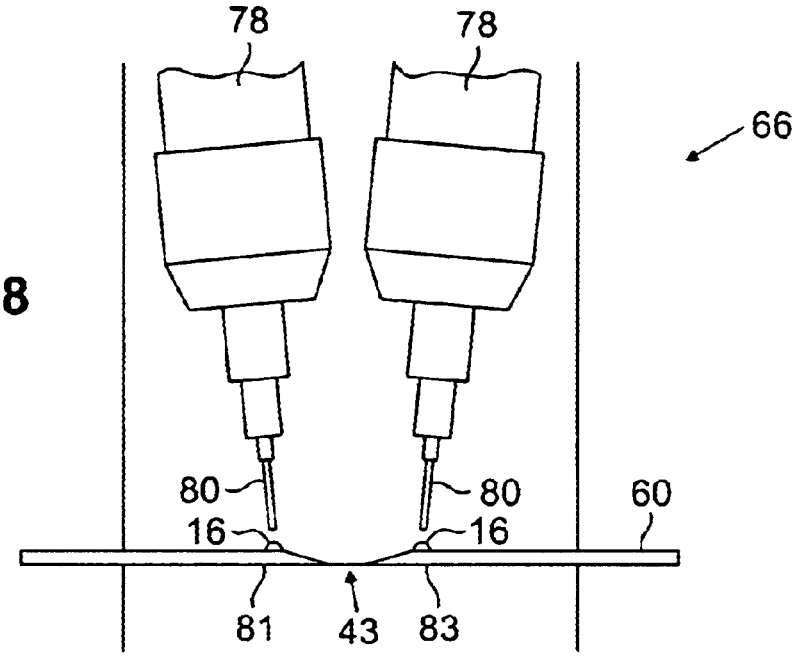
FIG. 8 is a schematic plan view of the glue applicator of an embodiment of the present invention.
Figure 9:
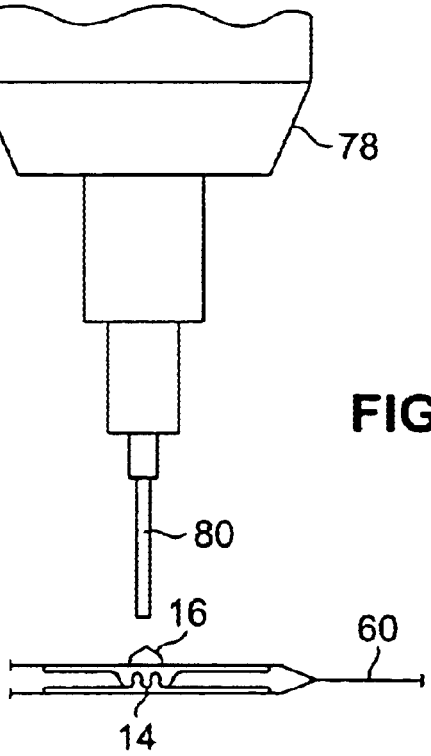
FIG. 9 is a schematic end view of the glue applicator of an embodiment of the present invention.

FIG. 8 shows a schematic view of the glue applicator 66. The glue applicator 66 preferably includes a pair of spool valves 78. The spool valves 78 each have a nozzle 80. Drops 16 of glue are applied to ends 81 and 82 of the crushed section 43 of the zippered closure 14 along the film 60. FIG. 9 shows an end schematic view of the glue applicator 66. The spool valves 78 preferably apply the drops 16 to a position in the center of the zippered closure 14. The drops 16 of glue are preferably of a UV curable glue.

Figure 10:
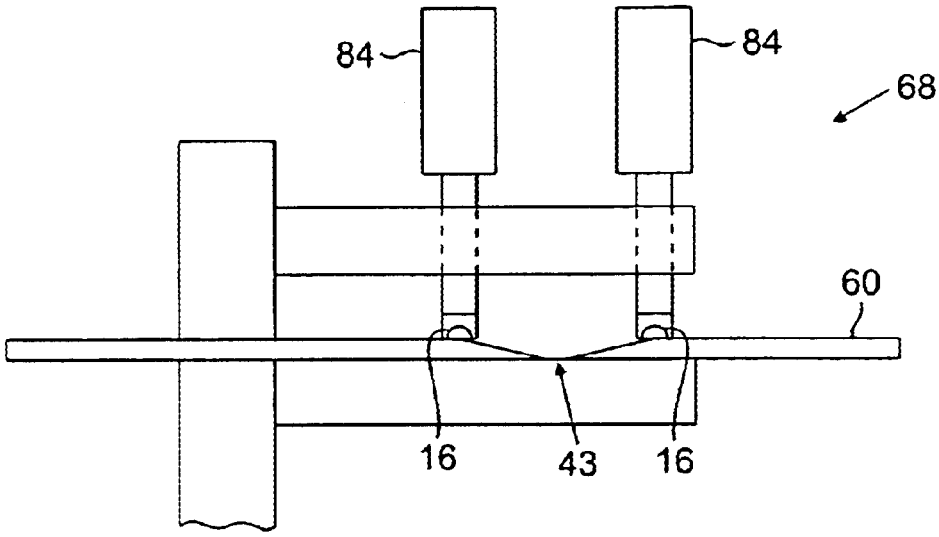
FIG. 10 is a schematic view of the glue curing station of an embodiment of the present invention.

FIG. 10 shows a schematic of the glue curing station 68. The glue curing station 68 includes a pair of light directors 84. The light directors 84 receive light from a light box (not shown), and direct it to shine on the drops 16. The light is preferably ultraviolet light of a type that is able to cure the UV curable glue of the drops 16 applied by the glue applicator 66.

It should be understood that various changes and modifications to the presently preferred embodiments described herein will be apparent to those skilled in the art. Such changes and modifications can be made without departing from the spirit and scope of the present invention and without diminishing its intended advantages. It is therefore intended that such changes and modifications be covered by the appended claims.

The invention is claimed as follows:

1. A bag having a front layer and a back layer and a mouth defining an opening having a first end and a second end, the bag comprising:

a front zipper profile positioned on an inner surface of the front layer proximate the mouth and extending between the first end and the second end;

a back zipper profile positioned on an inner surface of the back layer proximate the mouth and extending between the first end and the second end, the back zipper profile being dimensioned to interlock with the front zipper profile;

a slider arm mounted on the bag for reciprocating movement to move the mouth from an open position to a closed position where the front zipper profile and the second zipper profile are interlocked between the first end and the second end, the slider arm having a first edge and a second edge; and a first glue drop positioned at the first end of the mouth on an exterior surface of the front layer and positioned opposite the front zipper profile, the first edge of the slider arm engaging the glue drop when the mouth is in the open position or the closed position and the drop extends in a direction generally perpendicular to a planar surface of the front layer and having a height sufficient to halt the sliding of the slider arm.

2. The bag of claim 1, further comprising a second glue drop positioned at the second end of the mouth on an exterior surface of the first layer or the second layer.

3. The bag of claim 1, wherein the first drop is circular.

4. The bag of claim 1, wherein the first drop is linear.

5. The bag of claim 4, wherein the linear drop extends in a direction generally perpendicular to the front zipper profile.

6. The bag of claim 1, wherein the first drop is made of a curable glue.

7. The bag of claim 6, wherein the glue is curable by ultraviolet light.

8. The bag of claim 1, wherein the front zipper profile has a width, and the first drop is substantially centered on the width.

9. The bag of claim 1, wherein the first glue drop is adhesive-backed.

10. A method for making a reclosable bag comprising:

providing a bag having a mouth having a first end and second end and an interior surface, a zippered closure on the interior surface between the first end and a second end, and a slider arm mounted on the bag for reciprocating movement to open and close the mouth; and depositing a glue drop at the first end of the mouth on an exterior surface and opposite the zippered closure and having a height sufficient to haltingly abut the slider arm when the bag is in the opened or the closed position.

11. The method of claim 10, further comprising the step of placing a second drop at the second end of the zippered closure opposite the first drop.

12. The method of claim 11 wherein the slider has a first edge and a second edge, the slider being movable such that the first edge contacts the first drop at the first end of the zippered closure, and the second edge contacts the second drop at the second end of the zippered closure.

13. The method of claim 11, wherein the bag has a first edge and a second edge, and the first and second drops are located approximately 0.50 inches from the first and second edges, respectively.

14. The method of claim 12, wherein the first end and second end of the zippered closure define a length, the zippered closure including an interlockable front profile and back profile, the slider being movable to interlock the front profile and back profile, and the first and second drops are placed such that the slider interlocks the entire length of the zippered closure.

15. The method of claim 10, wherein the first drop is circular.

16. The method of claim 10, wherein the first drop is linear.

17. The method of claim 16, wherein the zippered closure has a length between the first end and second end, and the linear drop extends in a direction perpendicular to the length of the zippered closure.

18. The method of claim 10, wherein the first drop is made of a curable glue.

19. The method of claim 18, wherein the glue is curable by ultraviolet light.

20. The method of claim 10 wherein the slider has a first edge and a second edge and the front edge engages the glue drop when the mouth is in an open or closed position.

21. The method of claim 10, wherein the zippered closure has a width, and the first drop is substantially centered on the width of the zippered closure.

22. The method of claim 10, wherein the first glue drop is adhesive-backed.

23. A method of sealing a bag, the bag having a mouth, an inner surface, and an outer surface, the bag also having a zippered closure on the inner surface proximate the mouth, the zippered closure having a first end and a second end defining a length, the zippered closure also having an interlockable front profile and back profile, the bag having a glue drop on the outer surface opposite the zippered closure at the first end and extending from the surface a sufficient height to act as a stop, the method comprising:

providing a slider having a first edge and a second edge, the slider mounted to the bag for reciprocating movement;

sliding the slider along the length of the zippered closure to interlock the front profile and back profile; and terminating sliding upon the first edge or the second edge of the slider contacting the drop.

24. The method of claim 23, further comprising the bag having a second drop at the second end of the zippered closure opposite the first drop.

25. The method of claim 24, wherein the zippered closure has a width, and the first drop is substantially the centered on the width of the zippered closure.

26. The method of claim 24, wherein the first end and second end of the zippered closure define a length, the zippered closure including an interlockable front profile and back profile, the slider being movable to interlock the front profile and back profile, and the first and second drops are placed such that the slider interlocks the entire length of the zippered closure.

27. The method of claim 23, wherein the first drop is circular.

28. The method of claim 23 wherein the first drop is linear.

29. The method of claim 28, wherein the zippered closure has a length between the first end and second end, and the linear drops extends in a direction generally perpendicular to the length of the zippered closure.

30. The method of claim 23, wherein the first drop is made of curable glue.

31. The method of claim 30, wherein the glue is curable by ultraviolet light.

32. The method of claim 23, wherein the first drop is adhesive-backed.

* * * * *